United States Patent [19]

See

[11] Patent Number: 4,997,059

[45] Date of Patent: Mar. 5, 1991

[54] LOUDSPEAKER MOUNTING

[75] Inventor: Walter E. See, Kokomo, Ind.

[73] Assignee: Harman International Industries, Incorporated, Northridge, Calif.

[21] Appl. No.: 460,833

[22] PCT Filed: Mar. 16, 1988

[86] PCT No.: PCT/US88/00841

§ 371 Date: Dec. 18, 1989

§ 102(e) Date: Dec. 18, 1989

[87] PCT Pub. No.: WO88/10549

PCT Pub. Date: Dec. 29, 1988

[51] Int. Cl.[5] ..... G10K 13/00

[52] U.S. Cl. ..... 181/172; 181/141; 181/150; 381/193; 381/205

[58] Field of Search ..... 181/150, 171, 172, 159, 181/141; 381/205, 193

[56] References Cited

U.S. PATENT DOCUMENTS

| | | | |
|---|---|---|---|
| 3,666,040 | 5/1972 | Junk | 181/150 |
| 3,859,480 | 1/1975 | Birkver et al. | 181/171 X |
| 4,028,504 | 6/1977 | Massa | 381/205 X |
| 4,072,829 | 2/1978 | Ogihara | 381/205 |
| 4,143,249 | 3/1979 | Cinquino | 181/159 X |
| 4,179,009 | 12/1979 | Birkver | 181/171 |
| 4,387,788 | 6/1983 | Slavin et al. | 181/171 |
| 4,546,850 | 10/1985 | Litner | 181/141 |
| 4,752,962 | 6/1988 | Thiele et al. | 381/194 |

*Primary Examiner*—Benjamin R. Fuller
*Attorney, Agent, or Firm*—Barnes & Thornburg

[57] ABSTRACT

A transducer for mounting in an opening (90) defined in a baffle (84) includes an axis and a frame (10) for supporting the remaining transducer components in the baffle (84). The frame (10) includes at least a first finger (40) deflectable toward the transducer axis to permit passage of a portion of the frame (10) through the opening (90). The first finger (40) includes at least one camming surface (52, 54) for resiliently urging the first finger (40) toward the axis as the camming surface (52, 54) of the first finger (40) contacts the baffle (84) adjacent the opening (90) and a locking surface (94) for engaging the baffle (84) adjacent the opening (90) once the camming surface (52, 54) has passed completely through the opening (90).

12 Claims, 1 Drawing Sheet

LOUDSPEAKER MOUNTING

This invention relates to mounting techniques and apparatus. It is disclosed in the context of a mounting system for loudspeakers, but is believed to be useful in other fields as well.

In diaphragm-type loudspeaker manufacture and assembly, the most common technique for mounting the loudspeaker into a baffle is to provide holes around the perimeter of the speaker frame or "basket" and corresponding holes in the baffle. Fasteners, usually threaded fasteners, are inserted through aligned holes in the speaker frame perimeter and baffle to fix the speaker to the baffle. Typically, an elastomeric gasket having the same configuration as the perimeter of the frame is positioned between the perimeter and baffle to seal the two together to minimize the likelihood of relative movement and other phenomena which might otherwise result in the generation of noise between the frame and baffle.

This common technique requires the stocking of the fasteners, the provision of aligned holes in the frame, baffle and elastomeric gasket, and the labor involved in assembly of these components with the holes aligned using the fasteners. Frequently, this assembly is complicated by the configuration of the space in which the speaker is to be mounted. For example, when the mounting is into the baffle provided by the package tray underneath the rear window of an automobile, the fact that part of the process is conducted from inside the automobile interior and part is conducted from the trunk increases the complexity of the operation and thus the labor cost associated with assembly of the speaker into the baffle.

It is an object of the present invention to provide a transducer provided with means for fixing the transducer into a baffle in which the transducer is to be supported. The means for fixing the transducer into the baffle is so constructed that the transducer snaps into the baffle without the need for any fasteners or hardware other than fasteners formed integrally with the transducer.

According to the invention, a transducer for mounting in an opening defined in a baffle includes an axis and a frame for supporting the remaining transducer components in the baffle. The frame includes at least a first finger deflectable toward the transducer axis to permit passage of a portion of the frame through the opening. The first finger includes at least one camming surface for resiliently urging the first finger toward the axis as the camming surface of the first finger contacts the baffle adjacent the opening and a locking surface for engaging the baffle adjacent the opening once the camming surface has passed completely through the opening.

Illustratively, according to the invention, the frame includes a sidewall which extends generally parallel with the transducer axis, and a section of the frame sidewall generally perpendicular to the axis defines a closed plane curve. The closed plane curve can be, for example, substantially elliptical or substantially circular.

According to an illustrative embodiment, the transducer further comprises a first flange extending from the transducer sidewall away from the axis. The first flange extends at least partway around the perimeter of the frame. The first flange includes a first generally axially facing surface which faces, and is axially spaced from, the locking surface of the at least one finger. The axial spacing of the first axially facing surface of the first flange from the locking surface of the at least one finger is at least as great as the thickness of the baffle in the region surrounding the opening.

Additionally, according to an illustrative embodiment, the transducer comprises a second flange extending from the transducer sidewall away from the axis. The second flange extends at least partway around the perimeter of the frame. The second flange includes a generally axially facing surface which faces, and is axially spaced from, the axially facing surface of the first flange. The axial spacing of the axially facing surfaces of the first and second flanges is at least as great as the thickness of the baffle in the region surrounding the opening.

Further according to an illustrative embodiment, the first generally axially facing surface of the first flange extends substantially completely around the perimeter of the frame and the generally axially facing surface of the second flange extends no more than halfwaY around the perimeter of the frame.

Further according to an illustrative embodiment, the frame includes a second finger deflectable toward the transducer axis to permit passage of a portion of the frame through the opening. The second finger includes at least one camming surface for resiliently urging the second finger toward the axis as the camming surface of the second finger contacts the baffle adjacent the opening and a locking surface for engaging the baffle adjacent the opening once the camming surface has passed completely through the opening.

Additionally, according to an illustrative embodiment, the frame further comprises a third flange extending from the transducer sidewall away from the axis. The third flange extends at least partwaY around the perimeter of the frame. The third flange lies axially on the opposite side of the first flange from the second flange. The first flange includes a second generally axially facing surface facing in the opposite axial direction from the first generally axially facing surface of the first flange. The third flange includes a generally axially facing surface which faces, and is axially spaced from, the second axially facing surface of the first flange. The axial spacing of the second axially facing surface of the first flange and the axially facing surface of the third flange is at least as great as the thickness of the baffle in the region surrounding the opening.

According to an illustrative embodiment, the second generally axially facing surface of the first flange extends substantially completely around the perimeter of the frame and the generally axially facing surface of the third flange extends no more than halfway around the perimeter of the frame.

Illustratively, the locking surfaces of the first and second fingers extend generally radially of the transducer axis and face each other axially.

Additionally, according to an illustrative embodiment, the first camming surfaces of the first and second fingers extend generally radially of the transducer axis but slope somewhat axially. Each of the first and second fingers comprises a second camming surface. The second camming surfaces of the first and second fingers extend generally axially but slope somewhat radially of the transducer axis.

The invention may best be understood by referring to the following description and accompanying drawings which illustrate the invention. In the drawings.

Figure 1:
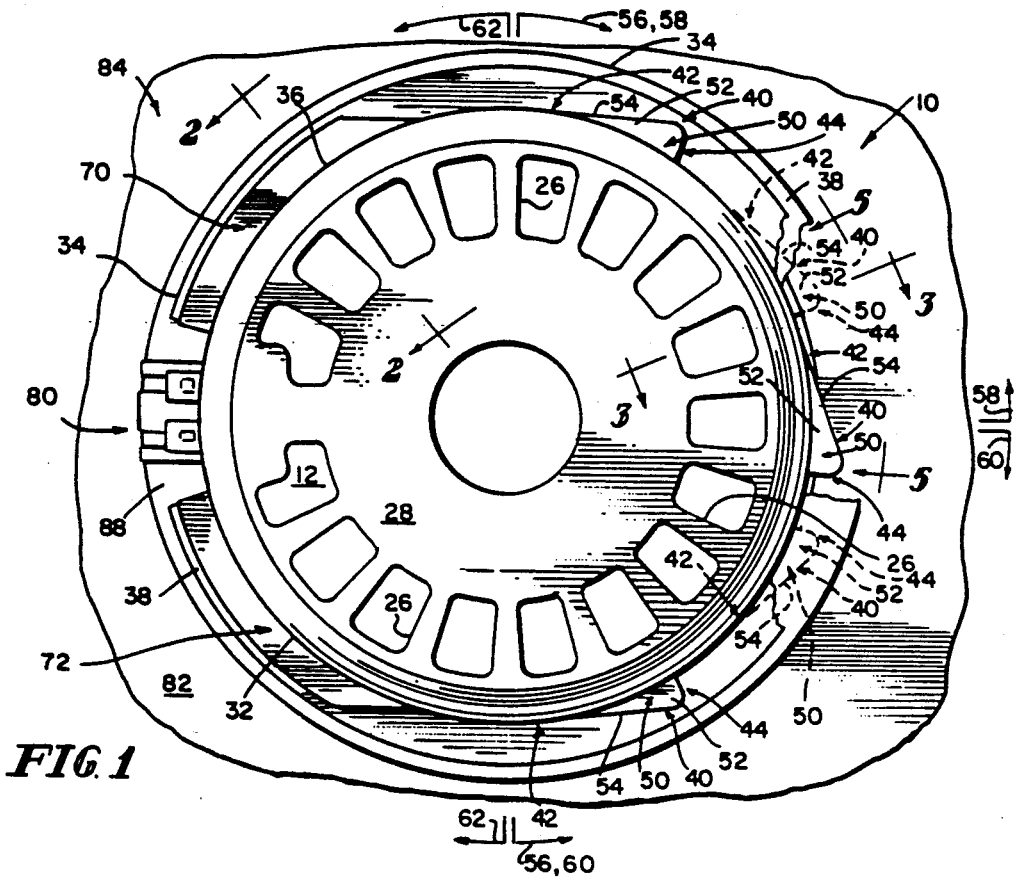
FIG. 1 illustrates a bottom plan view of a transducer incorporating the present invention mounted from beneath the rear package tray of an automobile.
Figure 2:
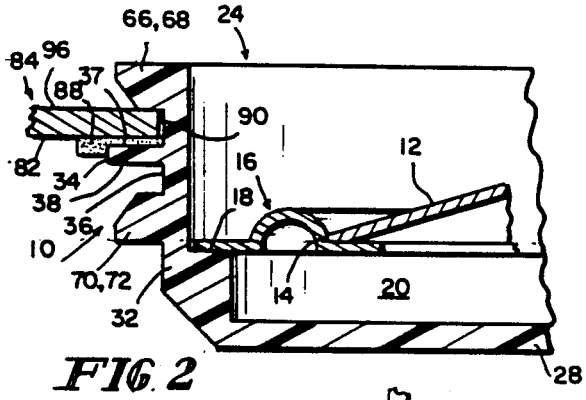
FIG. 2 illustrates a fragmentary sectional view of the apparatus of FIG. 1, taken generally along section lines 2—2 of FIG. 1.
Figure 3:
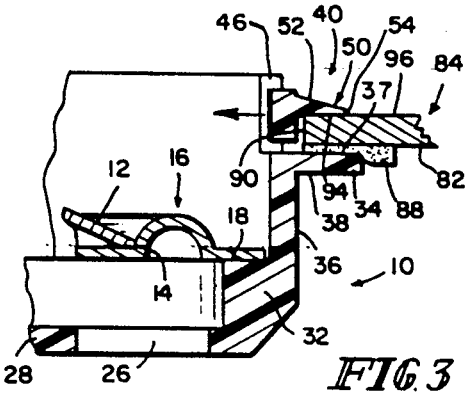
FIG. 3 illustrates a fragmentary sectional view of the apparatus of FIG. 1, taken generally along section lines 3—3 of FIG. 1.
Figure 4:
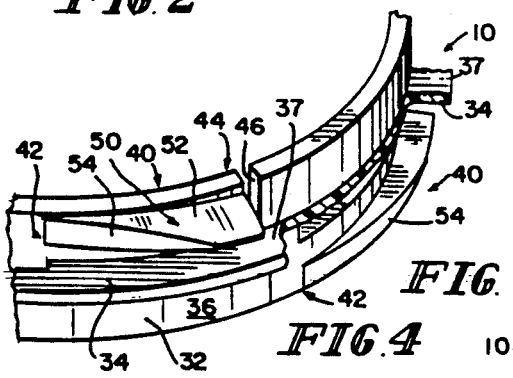
FIG. 4 illustrates a fragmentary perspective view of the apparatus of FIG. 1.
Figure 5:
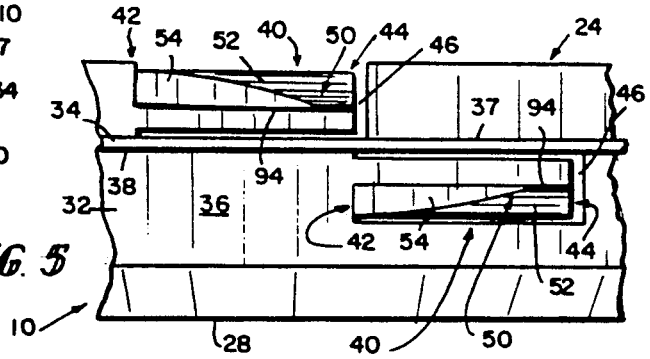
FIG. 5 illustrates a fragmentary sectional view of the apparatus of FIG. 1, taken generally along section lines 5—5 of FIG. 1.

Turning now to the drawings, a molded resin or filled resin loudspeaker frame 10 supports a moving coil (not shown) transducer including a diaphragm 12 by mounting the diaphragm 12 from its perimeter 14 (FIGS. 2-3) through a compliant suspension including a compliance 16 from a support 18 provided on the interior 20 of frame 12. The construction of the particular transducer illustrated is as described in co-pending U.S. Pat. application Ser. No. 36,566 filed Apr. 8, 1987 and assigned to the same assignee as this application. As is well known, frame 10 can be in the general configuration of a right elliptical cylinder or any other suitable shape instead of the generally right circular cylindrical configuration illustrated in FIG. 1. Also as is well known, frame 10 is open on its forward radiating side 24 and is provided with a plurality of vents 26 on its rearward side 28, all for purposes well known in the art. In addition to the compliance 16, suspensions for such transducers also ordinarily include centering spiders which center the voice coils of such transducers in the transducer air gaps. None of these details are illustrated because they do not relate to the present invention.

The generally cylindrical wall 32 of frame 10 is provided with a flange 34 which projects radially outwardly from the radially outer surface 36 of wall 32. On both the upper 37 (nearer to open end 24) and lower 38 (nearer to the vented 26 end 28) sides of flange 34, wall 32 is provided with axially and perimentrally extending, radially deflectable fingers 40. Each finger 40 is integrally formed at one 42 of its perimetrally opposed ends 42,44 with the cylindrical wall 32 of frame 10. A slot 46 at its other end 44, coupled with the resiliency of the material from which the frame 10 is formed, accounts for the radially deflectable characteristic of fingers 40.

Each finger 40 includes a radially outwardly projecting lug 50. Each lug 50 is provided with two camming surfaces 52, 54. Camming surfaces 52 are provided on generally axially facing (with respect to generally cylindrical wall 32) surfaces of the lugs 50 on the sides of respective lugs 50 facing away from flange 34. The camming surface 54 of each lug 50 extends generally perimetrally of wall 32 and faces generally radially outwardly. Fingers 40 are provided generally along approximately half 56 (FIG. 1) of the perimeter of wall 32. If the half 56 of the perimeter of wall 32 can be thought of as divided roughly in half again, the camming surfaces 54 on one quarter 58 of the perimeter slope generally in one direction and the camming surfaces 54 on the other quarter 60 slope generally in the other direction.

The other half 62 of the perimeter of wall 32 is provided with two radially outwardly projecting flange segments 66, 68 (FIG. 2) above flange 34 and two radially outwardly projecting flange segments 70, 72 (FIGS. 1-2) below flange 34. Flange segments 66, 68 are separated by, and flange segments 70, 72 are separated by, a connector 80 which is formed integrally with frame 10. Electrical connections are made to the voice coil (not shown) mounted in frame 10 through connector 80 by known techniques.

The installation of the loudspeaker of which frame 10 is a part proceeds as follows. If the speaker is to be installed from the rear side 82 of a speaker baffle 84, an elastomer gasket 88 having substantially the same interior perimetral configuration and size as the outer surface 36 is placed against the upper side 37 of flange 34. Frame 10 is then tilted at an angle so that flange segments 66, 68 are presented through the opening 90 in baffle 84. Steady pressure is then exerted against the back side 28 of frame 10 to cam the fingers 40 above flange 34 by camming surfaces 52 radially inwardly to permit the fingers 40 to pass through opening 90. Camming surfaces 54 aid in deflecting fingers 40 radially inward so that they can pass through opening 90. After fingers 40 have passed through opening 90, they snap radially outwardly, capturing frame 10 in baffle 84 through engagement of the flat radially extending surfaces 94 of fingers 40 against the front surface 96 of baffle 84. The spacing of fingers 40 from flange 34 is such that gasket 88 is compressed between front surface 37 of flange 34 and the back surface 82 of baffle 84 under these conditions.

If the speaker is to be installed from the front of baffle 84, gasket 88 is placed against the back side 38 of flange 34, frame 10 is tilted at an angle so that flange segments 70, 72 are presented through opening 90 and steady pressure is then applied to the front 24 of frame 10. The fingers 40 below flange 34 are cammed radially inward by their camming surfaces 52, 54 to permit the fingers 40 below flange 34 to pass through opening 90. These fingers then snap radially outwardly, capturing frame 10 in baffle 84. Once again, the spacing of the fingers 40 from flange 34 is such as to insure adequate compression of gasket 88 between the flange 34 and baffle 90 to reduce substantially the likelihood of mechanical noise from the installation, such as rattling of the frame 10 against baffle 90.

What is claimed is:

1. A transducer for mounting in an opening defined in a baffle having a thickness in a region surrounding the opening, the transducer including an axis and a frame for supporting the transducer in the baffle, the frame including a sidewall defining a perimeter, a first finger deflectable toward the transducer axis to permit passage of a portion of the frame through the opening, the first finger including at least one camming surface for resiliently urging the first finger toward the axis as the at least one camming surface of the first finger contacts the baffle adjacent the opening and a locking surface for engaging the baffle adjacent the opening once the at least one camming surface of the first finger has passed completely through the opening, a first flange extending from the sidewall away from the axis, the first flange extending at least partway around the perimeter of the frame, the first flange including a first generally axially facing surface which faces, and is axially spaced from, the locking surface of the first finger, the axial spacing of the first axially facing surface of the first flange from the locking surface of the first finger being at least as great as the thickness of the baffle in the region surrounding the opening for capturing a portion of the region between the first axially facing surface of the first flange and the locking surface of the first finger, and a second flange extending from the sidewall away from the axis, the second flange extending at least partway around the perimeter of the frame, the second flange including a generally axially facing surface which faces, and is axially spaced from, the axially facing surface of the first flange, the axial spacing of the axially facing surfaces of the first and second flanges being at least as great as the thickness of the baffle in the region surrounding the opening for capturing a portion of the region between the axially facing surfaces of the first and second flanges.

2. The apparatus of claim 1 wherein the first generally axially facing surface of the first flange extends substantially completely around the perimeter of the frame and the generally axially facing surface of the second flange extends no more than halfway around the perimeter of the frame.

3. The apparatus of claim 1 wherein the frame further includes a second finger deflectable toward the transducer axis to permit passage of a portion of the frame through the opening, the second finger including at least one camming surface for resiliently urging the second finger toward the axis as the at least one camming surface of the second finger contacts the baffle adjacent the opening and a locking surface for engaging the baffle adjacent the opening once the at least one camming surface of the second finger has passed completely through the opening.

4. The apparatus of claim 3 wherein the first flange includes a side adjacent the second flange and an opposite side from the second flange, the apparatus further comprising a third flange extending from the sidewall away from the axis, the third flange extending at least partway around the perimeter of the frame, the third flange lying axially on the opposite side of the first flange from the second flange, the first flange including a second generally axially facing surface facing in the opposite axial direction from the first generally axially facing surface of the first flange, the third flange including a generally axially facing surface which faces, and is axially spaced from, the second axially facing surface of the first flange, the axial spacing of the second axially facing surface of the first flange and the axially facing surface of the third flange being at least as great as the thickness of the baffle in the region surrounding the opening for capturing a portion of the region between the second axially facing surface of the first flange and the axially facing surface of the third flange.

5. The apparatus of claim 4 wherein the second generally axially facing surface of the first flange extends substantially completely around the perimeter of the frame and the generally axiallY facing surface of the third flange extends no more than halfway around the perimeter of the frame.

6. The apparatus of claim 3 wherein the locking surfaces of the first and second fingers extend generally radially of the axis and face each other axially.

7. The apparatus of claim 6 wherein the first camming surfaces of the first and second fingers extend generally radially of the axis but slope somewhat axially.

8. The apparatus of claim 7 wherein each of the first and second fingers comprises a second camming surface, the second camming surfaces of the first and second fingers extending generally axially but sloping somewhat radially of the axis.

9. The apparatus of claim 6 wherein the first flange includes a second generally axially facing surface, the first flange lying axially between the locking surfaces of the first and second fingers, the first generally axially facing surface of the first flange facing the locking surface of the first finger and the second generally axially facing surface of the first flange facing the locking surface of the second finger.

10. The apparatus of claim 9 and further comprising a third flange extending from the sidewall away from the axis, the third flange including a generally axially facing surface, the generally axially facing surface of the third flange facing, and being axially spaced from, the second generally axially facing surface of the first flange.

11. The apparatus of claim 10 wherein the first and second generally axially facing surfaces of the first flange extend substantially completely around the perimeter of the frame and the generally axially facing surfaces of the second and third flanges extend no more than halfway around the perimeter of the frame.

12. The apparatus of claim 10 wherein the axial spacing of the locking surface of the first finger and the axially facing surface of the second flange from the first generally axially facing surface of the first flange is at least as great as the thickness of the baffle in the region surrounding the opening, and the axial spacing of the locking surface of the second finger and the axially facing surface of the third flange from the second generally axially facing surface of the first flange is at least as great as the thickness of the baffle in the region surrounding the opening.

* * * * *